US010006248B2

(12) United States Patent
Goodnow et al.

(10) Patent No.: US 10,006,248 B2
(45) Date of Patent: Jun. 26, 2018

(54) STEP ADAPTER FOR RUNG LADDERS

(71) Applicant: Willow Step, Inc., Huntingdon Valley, PA (US)

(72) Inventors: Dennis J. Goodnow, Pennellville, NY (US); John C. Godfrey, Huntingdon Valley, PA (US); Albert L. Chase, Lansdale, PA (US)

(73) Assignee: Willow Step, Inc., Huntingdon Valley, PA (US)

( * ) Notice: Subject to any disclaimer, the term of this patent is extended or adjusted under 35 U.S.C. 154(b) by 0 days. days.

(21) Appl. No.: 15/442,161

(22) Filed: Feb. 24, 2017

(65) Prior Publication Data

US 2017/0167198 A1 Jun. 15, 2017

Related U.S. Application Data

(63) Continuation-in-part of application No. 15/165,183, filed on May 26, 2016, now Pat. No. 9,890,589.

(60) Provisional application No. 62/167,013, filed on May 27, 2015.

(51) Int. Cl.

| | |
|---|---|
| ***E06C 7/00*** | (2006.01) |
| ***E06C 7/16*** | (2006.01) |
| ***E06C 7/08*** | (2006.01) |

(52) U.S. Cl.

CPC ..... *E06C 7/165* (2013.01); *E06C 7/08* (2013.01); *E06C 7/16* (2013.01)

(58) Field of Classification Search

CPC ..... E06C 7/16; E06C 7/165

See application file for complete search history.

(56) References Cited

U.S. PATENT DOCUMENTS

| | | | | |
|---|---|---|---|---|
| 169,236 | A | 10/1875 | Case et al. | |
| 335,051 | A | 1/1886 | Ayres | |
| 407,079 | A | 7/1889 | Laskey | |
| 745,750 | A | 12/1903 | Ziegler et al. | |
| 1,285,817 | A * | 11/1918 | Sklar | E06C 7/165 182/120 |
| 1,820,315 | A | 8/1931 | Miller | |
| 1,920,552 | A | 8/1933 | Dollerhide | |

(Continued)

FOREIGN PATENT DOCUMENTS

| | | | |
|---|---|---|---|
| CH | 485108 | A | 3/1970 |
| FR | 1436743 | A | 4/1966 |

(Continued)

*Primary Examiner* — Colleen M Chavchavadze

(74) *Attorney, Agent, or Firm* — Breiner & Breiner, L.L.C.

(57) ABSTRACT

Step adapters for a rung ladder to provide increased support surface or area is described. In one embodiment, the step adapter includes brace, platform, lock and safety bar sections. The lock, safety bar and platform sections structurally engage a rung of a ladder, and the brace section supports the adapter against rails of a ladder so that the step adapter provides an extended step structure to ease standing on the ladder. In another embodiment, the step adapter includes brace, platform and lock sections, where the platform section side edges are configured to lock the step adapter in place on a rung of a ladder. A tray overlay can be used in combination with the step adapter (which serves as support) to provide an area for holding work-related items. The step adapter can also include a securing element as an additional safety feature to anchor the adapter to a ladder.

20 Claims, 16 Drawing Sheets

(56) References Cited

U.S. PATENT DOCUMENTS

| | | | | | |
|---|---|---|---|---|---|
| 2,103,603 | A | * | 12/1937 | Voigt | E06C 7/165 182/120 |
| 2,104,987 | A | * | 1/1938 | Harding | E06C 7/16 182/121 |
| 2,486,783 | A | | 11/1949 | Hartman et al. | |
| D157,206 | S | | 2/1950 | Ronfeldt | |
| 2,500,559 | A | | 3/1950 | Miller | |
| D158,136 | S | * | 4/1950 | Simon | 182/121 |
| 2,528,317 | A | * | 10/1950 | Newman | E06C 7/165 182/120 |
| 2,606,079 | A | | 8/1952 | White | |
| 2,805,104 | A | * | 9/1957 | Johnson | E06C 7/165 182/120 |
| 2,827,336 | A | | 3/1958 | Johnson | |
| 2,899,011 | A | * | 8/1959 | Babits | E06C 7/165 182/120 |
| 2,948,350 | A | | 8/1960 | Bohannan | |
| D188,758 | S | * | 9/1960 | Parker | D25/65 |
| 3,115,214 | A | | 12/1963 | Roberts | |
| 3,294,197 | A | | 12/1966 | Kwiatkowski | |
| 3,511,338 | A | | 5/1970 | Chapman | |
| D248,777 | S | | 8/1978 | Spencer et al. | |
| 4,211,307 | A | | 7/1980 | Ethridge | |
| 4,401,187 | A | | 8/1983 | Van Patten | |
| 4,437,544 | A | | 3/1984 | Anderson et al. | |
| 4,480,810 | A | | 11/1984 | Hall | |
| 4,482,030 | A | | 11/1984 | Lincourt | |
| 4,542,874 | A | | 9/1985 | Ronning | |
| 4,618,030 | A | | 10/1986 | Campbell | |
| 4,800,988 | A | | 1/1989 | Dunmore | |
| 4,899,970 | A | | 2/1990 | Berzina | |
| 4,911,265 | A | | 3/1990 | Skaggs | |
| 4,953,661 | A | | 9/1990 | Hilton et al. | |
| 5,005,668 | A | | 4/1991 | Nowlan | |
| 5,044,466 | A | * | 9/1991 | Jacobsmeyer, Jr. | E06C 7/16 182/119 |
| 5,052,515 | A | | 10/1991 | Nowlan | |
| 5,056,620 | A | * | 10/1991 | Zumwalt | E06C 7/165 182/120 |
| 5,388,665 | A | | 2/1995 | Newman | |
| 5,465,809 | A | | 11/1995 | Panicci | |
| 5,584,453 | A | | 12/1996 | Morter | |
| D390,669 | S | | 2/1998 | Armstrong et al. | |
| 5,779,208 | A | | 7/1998 | McGraw | |
| D409,765 | S | | 5/1999 | Armstrong et al. | |
| 5,975,240 | A | | 11/1999 | O'Brien | |
| D434,158 | S | | 11/2000 | Armstrong et al. | |
| 6,786,300 | B1 | | 9/2004 | Bonifacini | |
| 6,966,406 | B2 | | 11/2005 | Nash, Jr. | |
| D523,156 | S | | 6/2006 | Skaggs | |
| 7,861,826 | B2 | | 1/2011 | Meyers et al. | |
| 8,657,070 | B2 | * | 2/2014 | O'Brien | E06C 7/165 182/120 |
| 8,727,074 | B1 | * | 5/2014 | Bhajan | E06C 7/165 182/119 |
| D728,128 | S | | 4/2015 | Haney | |
| 2002/0189902 | A1 | | 12/2002 | Nelson | |
| 2004/0163890 | A1 | | 8/2004 | Nash, Jr. | |
| 2007/0068732 | A1 | | 3/2007 | Nagle | |
| 2007/0240935 | A1 | | 10/2007 | O'Brien et al. | |
| 2011/0297482 | A1 | | 12/2011 | O'Brien et al. | |
| 2014/0326538 | A1 | | 11/2014 | Najey | |
| 2016/0177626 | A1 | | 6/2016 | Miller | |
| 2016/0369561 | A1 | | 12/2016 | Jones | |
| 2016/0376844 | A1 | * | 12/2016 | Najey | E06C 7/165 182/120 |

FOREIGN PATENT DOCUMENTS

| | | | |
|---|---|---|---|
| FR | 2626933 | A | 8/1989 |
| GB | 2318607 | A | 4/1998 |
| JP | 2011021331 | A | 2/2011 |
| WO | 2015063467 | A1 | 5/2015 |

* cited by examiner

FIG. 8
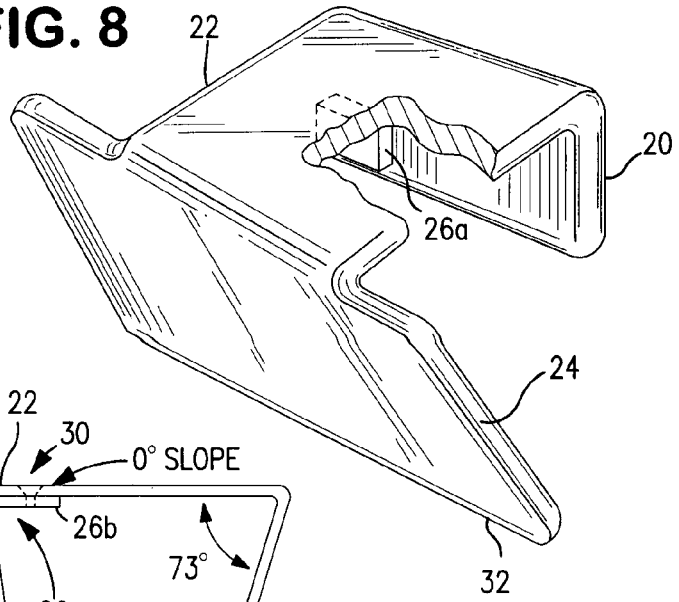
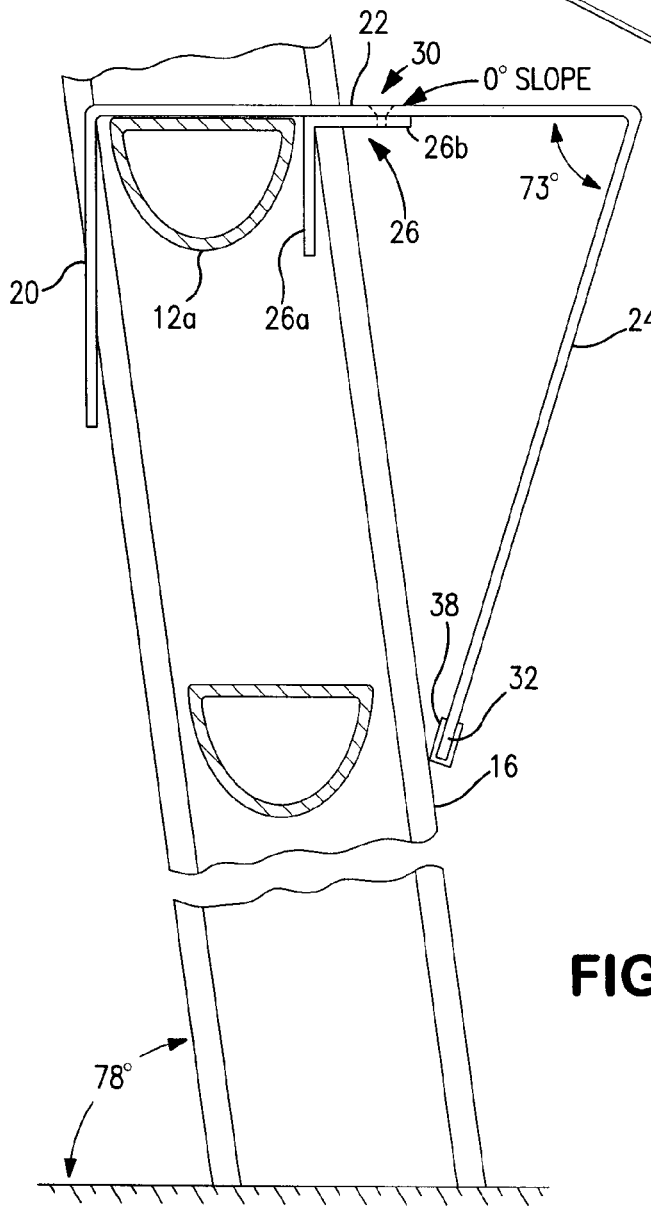
FIG. 9

STEP ADAPTER FOR RUNG LADDERS

RELATED APPLICATION

The present application is a continuation-in-part of and claims benefit of Non-provisional application Ser. No. 15/165,183 filed May 26, 2016, which claims benefit of U.S. Provisional Patent Application Ser. No. 62/167,013 filed May 27, 2015, which are each incorporated herein by reference.

FIELD OF INVENTION

Step adapters for rung ladders are described which provide for increased step or support area on a ladder rung. The step adapters are structurally simple for ease of manufacture and use, and which provide safety in use of both the step adapter and a rung ladder. The step adapter is provided with a securing element to anchor the adapter in place during use. Further, a tray overlay in combination with a step adapter serving as a support element is described to provide a platform for holding work items on a rung ladder.

BACKGROUND OF THE INVENTION

The step adapter of the invention is useful with rigid ladders having rungs or steps for ascending the ladder and standing on while performing work from the ladder. The rungs are supported by two vertical side members called rails or stringers or stiles. Rung ladders can be made of metal, wood, fiberglass or tough plastic. The rungs can be round, semi-round with the flat side facing upward, or flat.

Rung ladders of popular use are rigid ladders for leaning against another structure during use, for example, an extension ladder for leaning against a building. Leaning ladders for safety purposes need to be placed at a proper angle to reduce risk of falling. The safest angle for a ladder has been considered to be 75.5°. If the angle is too shallow, the bottom of the ladder is at the risk of sliding. If the angle is too steep, the ladder is at the risk of falling backwards.

Due to the (1) nature of the angle of work when a user is on a leaning ladder, (2) limited space on a rung of the ladder, and (3) need to stand in one place to maintain stability, standing on a ladder for an extended period of time, especially on a narrow rung is tiring and stressful to the feet and legs. This is especially true when the rungs are round (so as to be useful regardless of the angle of the ladder). Accordingly, a need is present to increase the support area of a rung for safety and to reduce stress on the feet and legs.

In the past, various devices have been developed to extend the size of the rungs or steps of a ladder. Generally, however, such have been complex as to structure and, thus, more difficult to use and manufacture.

SUMMARY OF INVENTION

Step adapters for a rigid rung ladder are described which are safe in use and provide an increased support surface to a user to reduce stress on the feet and lower legs of a user, especially over a period of extended use.

The step adapters are structured for attachment to a rung ladder by engagement with a rung of the ladder.

A first and preferred embodiment of the step adapter includes a brace element, a platform element, a lock element and a safety element. At least the brace, platform and lock elements are of one piece. Alternatively, all of the brace, platform, lock and safety elements are of one piece. The step adapter is preferably made from a metal, such as aluminum or aluminum alloy, or is an injection molded piece of tough plastic, both of which provide a lightweight structure with weight-bearing strength.

The step adapter of the first embodiment includes as a top portion the platform element from which the brace element extends downward from the front of the platform section and from which the lock element extends downward from the back of the platform section. The safety element extends from the underside surface of the platform element. The safety element may be one piece with the platform element or may be a separate piece fastened to the underside of the platform element, such as by a rivet, screw and bolt, or other suitable fastening structure. The fastener(s) are preferably countersunk into the upper surface of the platform element to maintain an essentially level top surface of the platform.

The platform, lock and safety elements are sized to have a width and structure to pass between the rails of a rung ladder and over a rung to engage the rung. The brace element has a width sufficient to extend across and abut the upper or outer exposed surface of the rails of the rung ladder. The lock element and safety element partially surround a selected rung and in conjunction with the brace element secure the step adapter to the rung ladder, providing the platform element as an extended surface to the rung and, thus, an increased support area for the user of the rung ladder. In use, a user selects any rung on the ladder based on the height desired to attach the step adapter and provide an increased support area for the user. The platform element has a length that extends outward left and right toward the rails, but not engaging the rails, and is supported by the brace element engaging the rails.

A second embodiment of the step adapter includes a brace element, a platform element, and a lock element. A separate safety element as present in the first embodiment, however, is not required. Rather, the platform element has side edges which are of a different configuration and serve to hold the step adapter in place in relation to the rails of a rung ladder to block the step adapter from moving forward through the ladder rails. The brace element and lock element are of the same structure in the second embodiment as described above in relation to the first embodiment. If desired, the second embodiment of the step adapter can also include the safety element of the first embodiment to provide the step adapter with redundant features for maintaining the step adapter securely in place on a ladder rung.

The step adapter of either the first or the second embodiment or variations thereof can also be provided with a securing element to further anchor the step adapter in place on a rung ladder during use of the step adapter on the rung ladder. A preferred embodiment of the securing element includes a plurality of holes spaced apart along or adjacent to a bottom edge of the brace element. The securing element includes a first end including a first attachment member, preferably non-removable, for attaching the securing element to the step adapter; an elastic segment; and a second end including a second attachment member for removably attaching the securing element to the step adapter. In use, preferably, at least one securing element is attached by an appropriate first attachment member to one end of the brace element, the elastic segment extends around a rail of the ladder, and the second attachment member, for example a hook, engages one of the holes so that the securing element is taut to securely hold the step adapter in place on a rung of the ladder. The securing element serves to additionally insure that the step adapter is not accidentally displaced from a rung when in use on a rung ladder. Necessarily, a second securing element can further be included if a redundant safety system is desired.

The step adapter of either the first or the second embodiment can also be provided with a service table or tray overlay. In this embodiment, the step adapter serves as a support element to provide a surface area for holding items being used by a person while the person is working on the ladder, e.g., paint can, tools, drink container, etc. Preferably, one or more edges of the overlay will include an upraised wall portion or curb to keep items from sitting over (or going over) the edge of the overlay. The overlay can be made of metal or plastic. When the overlay is made of plastic, the overlay can be provided with recessed areas of different geometric configurations suitable for holding a drink container, paint can, tools, etc.

BRIEF DESCRIPTION OF THE DRAWINGS

FIG. 8 is a side perspective view of a one-piece injection molded step adapter of the first embodiment.

FIG. 9 is a side view of the step adapter of the first embodiment engaged on a rung of a ladder leaning at a 78° angle.

DETAILED DESCRIPTION OF THE PREFERRED EMBODIMENTS

The step adapters will be described with reference to the drawings.

Figure 1:
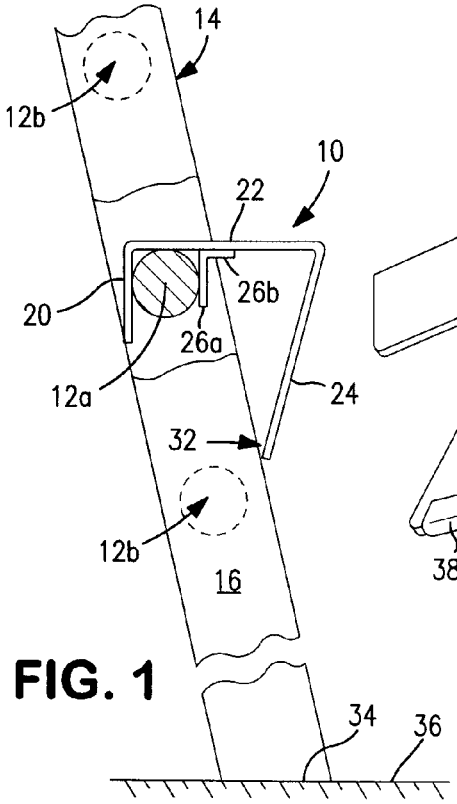
FIG. 1 is a side view of the step adapter of a first embodiment of the invention positioned in use on a rung of a leaning rigid rung ladder.

As to the first embodiment, the step adapter 10 is shown in FIG. 1 positioned for use on a rung 12*a* of a ladder 14 and against a rail 16. Rail 16 is cut away at rung 12*a*. Other rungs 12*b* are shown in dashed lines where rail 16 is not cut away. The step adapter in use can be positioned for engagement with any rung in accordance with the level at which work is to be conducted. The rungs can be round, semi-round with a flat side facing upward, or flat.

Figure 7:
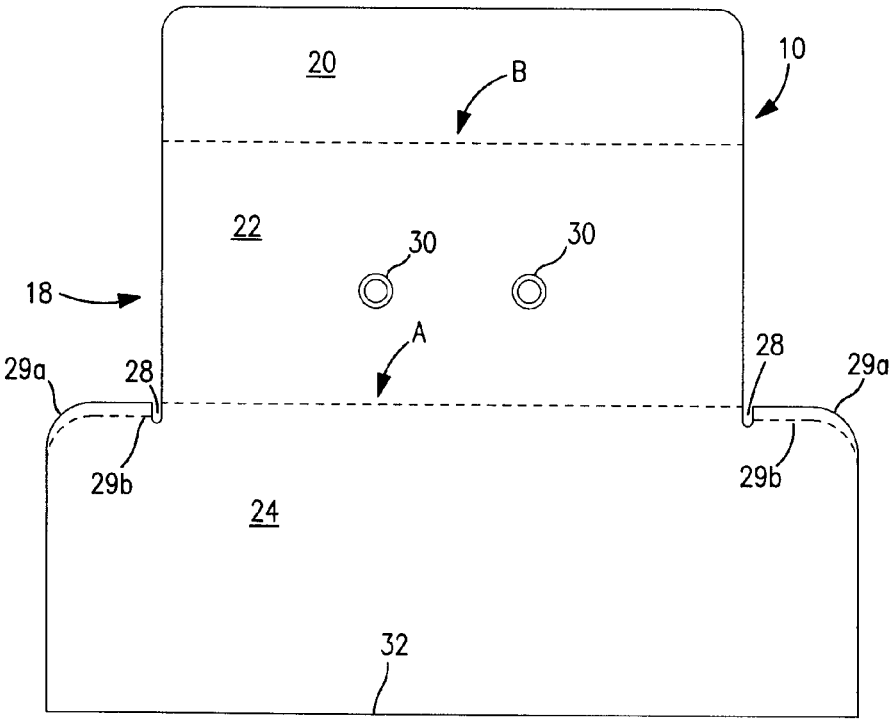
FIG. 7 is a top plan view of a sheet format which will form a step adapter of the first embodiment once the sections are angled appropriately.
Figure 3:
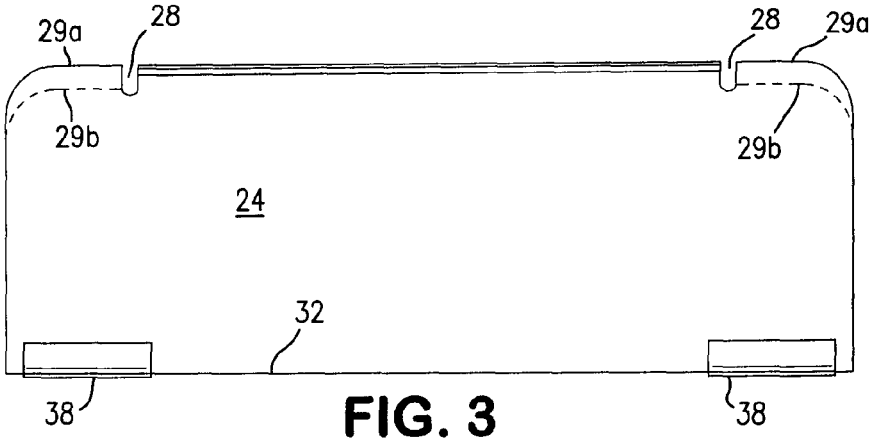
FIG. 3 is a front plan view of the step adapter of the first embodiment.
Figure 4:
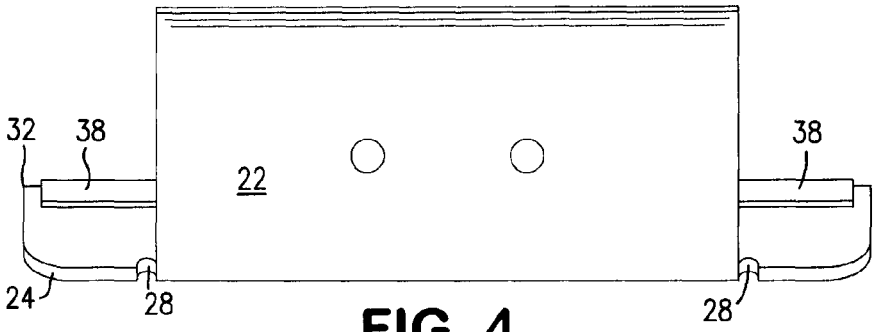
FIG. 4 is a top plan view of the step adapter of the first embodiment.

The step adapter is preferably formed from a sheet of metal 18, preferably a sheet of aluminum alloy from which the body of the step adapter is stamped out of such as shown in FIG. 7. The sheet preferably has a thickness in a range of about ⅛ to about 7/32 inches (about 3.175 to about 5.556 mm), with the preferred thickness of a metal sheet being ⅛ inch (3.175 mm) thick. Alternatively, the step adapter can be injection molded using a plastic to provide a rigid plastic structure. The preferred thickness of an injection molded structure is in a range of from about ¼ to about ⅝ inches (about 6.35 to about 15.875 mm), with the preferred thickness being ¼ inch (6.35 mm). The final interior surface structure of the injection molded step adapter, i.e., the surfaces coming into contact with the rung and rails of the ladder, is otherwise the same as the step adapter made from sheet metal. The corners of both the sheet metal embodiment and the injection molded embodiment are preferably rounded for enhanced safety purposes.

The structure of the step adapter includes a lock element 20, a platform element 22, a brace element 24 and a safety element 26.

Figure 2:
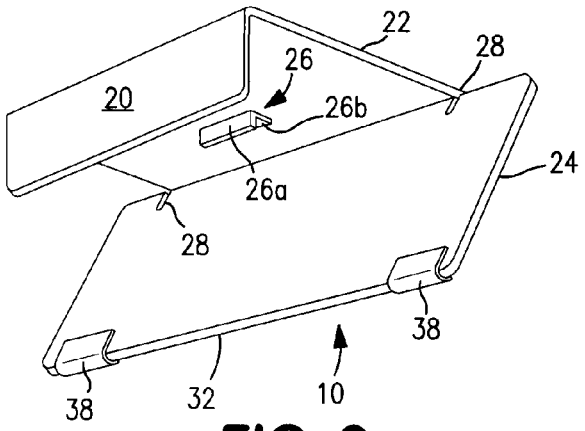
FIG. 2 is an underside rear perspective view of the step adapter shown in FIG. 1.

FIG. 7 shows a sheet metal format for the step adapter shown in FIG. 2. As shown in FIG. 7, the lock section 20 and platform section 22 in a preferred embodiment have a common width. As used herein the width is the measurement from left to right when viewing the step adapter from the front, i.e., facing the brace element. The length is thus the measurement from front to back of an element or section. As seen in FIG. 7, the length of the lock section is less than the length of the platform section. The brace section has a greater width than each of the platform and lock sections wherein the width of the brace section is sufficient to extend across both rails of a ladder and to abut against each rail of the ladder in use. The dashed lines A and B in FIG. 7 indicate the transition or bend points between the lock, platform and brace sections. At the transition or bend point (line A) between the platform section 22 and brace section 24, the point of intersection between the side edge of the platform element and the top free edge of the brace element is preferably a rounded 90° angle (such as angle 27 shown in FIG. 14). However, in an alternative embodiment, notches 28 can be present as an added safeguard against tearing of the metal sheet during bending in the manufacturing process of the adapter which may occur due to the difference in width. Notches 28 do not have to be too deep to provide this effect, e.g., a depth of about ⅛ to about ¼ inch (about 3.175 to about 6.35 mm) is sufficient. As shown in FIG. 7, notch 28 can have a greater depth in relation to the shoulder 29*a*, or the notch can be reduced in depth resulting in a lower shoulder 29*b* (shown in dashed lines). The same effect is achieved and no difference in strength, i.e., weight bearing capacity, of the step adapter occurs. A shallow depth of the notch is preferred for safety purposes, i.e., to provide a space which decreases the chance of or prevents catching anything associated with a user within the space during use of the step adapter, such as a loose shoe lace.

Lock section 20 is bent at line B to provide a downward extending section in relation to the top surface of platform section 22. The angle at which lock section 20 is bent is sufficient for lock section 20 to extend around and beyond a rung of a ladder. The preferred bend angle provided is 90°. Lock section 20 works in conjunction with safety section 26 to engage a rung and hold the step adapter in place around the rung. Safety section 26 has a downward extending bar 26*a*. In the step adapter embodiment made from sheet metal, the safety section will be a separate element such as a corner or L-shaped element having downward extending bar 26*a* and extension 26*b* which is secured by a suitable fastener to the underside of platform section 22. This may entail providing holes 30 in platform section 22 which receive suitable fasteners which in turn extend through holes (not shown) in the extension 26*b* of safety section 26. The fasteners may be rivets, screw and bolt combinations, lock-screws or the like. The holes are preferably such that the head of the fasteners are countersunk in the platform section so as to provide an essentially level top surface to platform section 22. In the alternative embodiment of an injection molded step adapter, as shown in FIG. 8, the safety section 26 may be simply a downward extending bar 26*a* since no fastener is necessary since the structure is preferably one piece. In either embodiment, the angle of downward extending bar 26*a* and lock section 20 is preferred to be 90° in relation to platform section 22 so as to readily and securely encompass a rung to hold the step adapter in place thereon.

Figure 15:
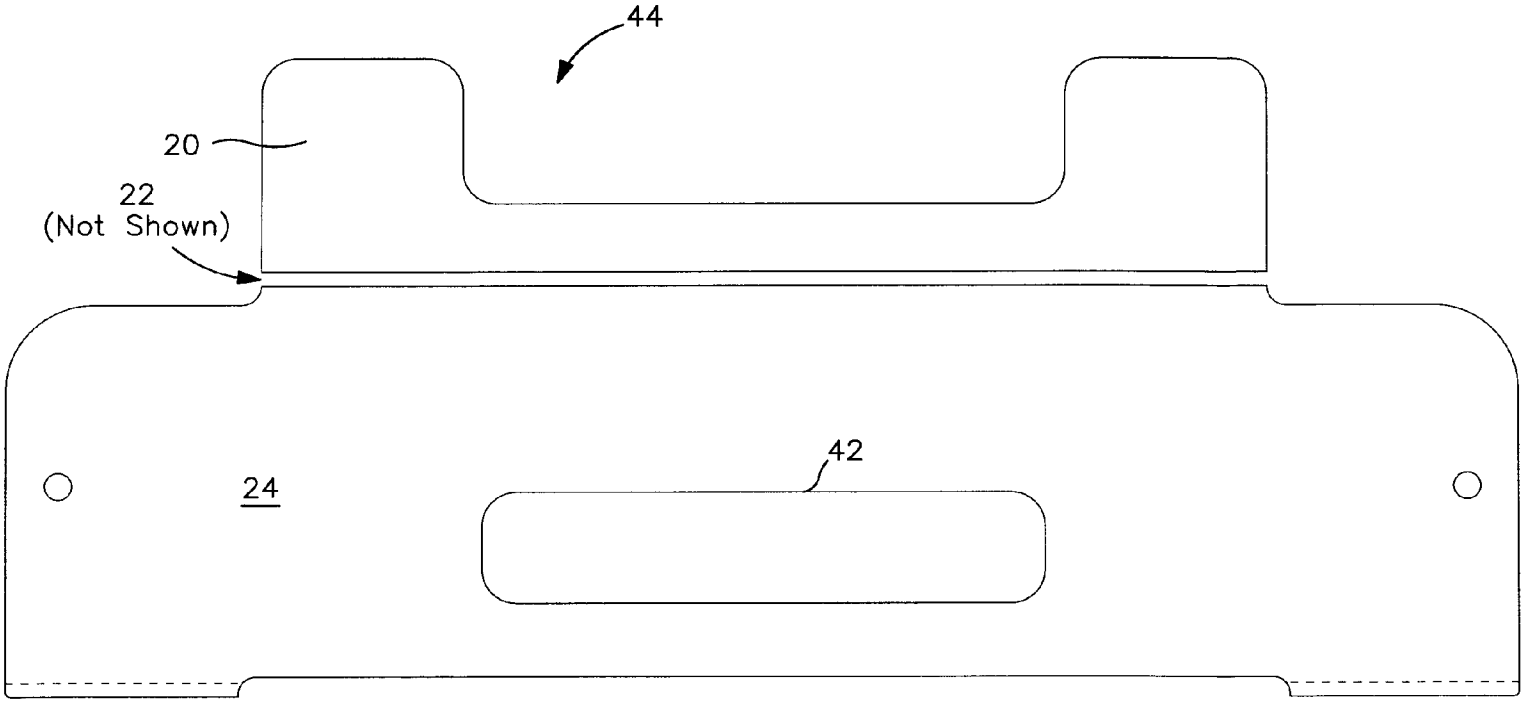
FIG. 15 illustrates an embodiment of a modified step adapter of the first embodiment used in weight bearing tests which are described below.

An optional feature for inclusion in lock section 20 is a cutout 44 (see FIG. 15). This cutout results in reducing the overall weight of the step adapter due to less material being present. The step adapter will thus be lighter and easier to handle in use. This is more notable in the metal embodiment of the step adapter than the plastic embodiment. The provision of cutout 44 in lock section 20 does not have an effect on the weight bearing capacity of the aluminum step adapter.

A further support and securing element of the step adapter operating in conjunction with the lock and safety elements is brace element 24 which includes a bottom edge 32 which abuts or rests on the top exposed surface of the pair of rails of a rigid ladder. Brace element 24 is bent at line A (see FIG. 7) in relation to platform section 22 so as to be angled downward in a manner to allow the top of platform section 22 to be a support area and the bottom edge 32 to rest on rails 16 of the ladder.

Figure 11:
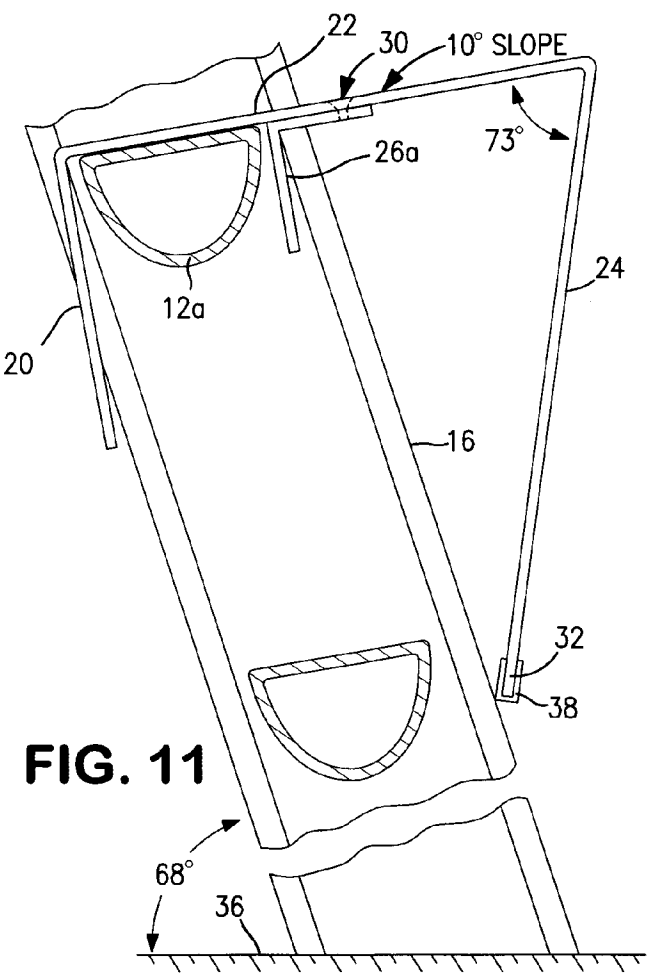
FIG. 11 is a side view of the step adapter of the first embodiment engaged on a rung of a ladder leaning at a 68° angle.
Figure 10:
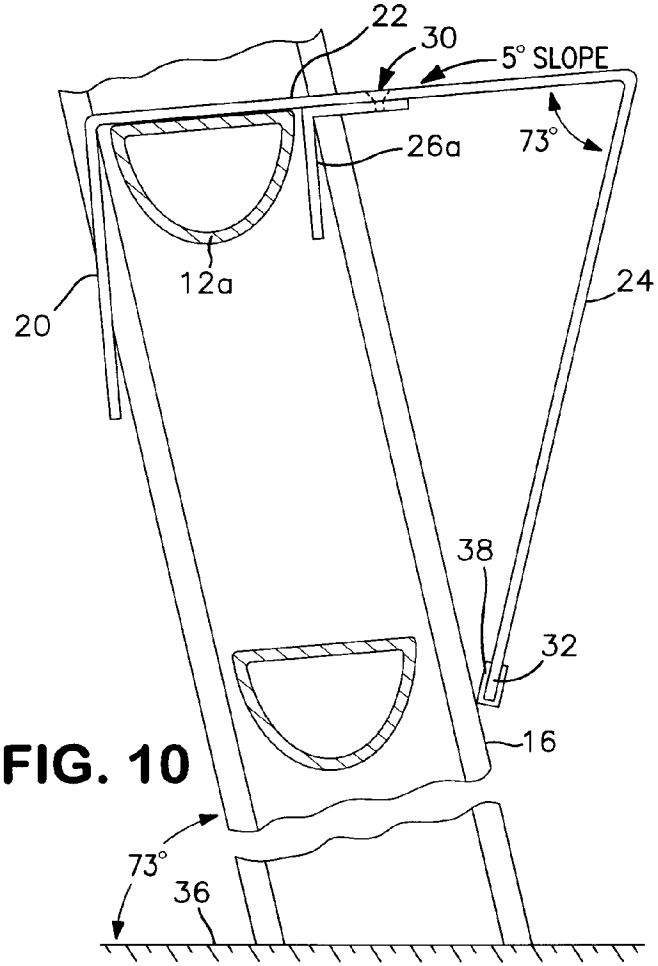
FIG. 10 is a side view of the step adapter of the first embodiment engaged on a rung of a ladder leaning at a 73° angle.

Generally, in use, rigid ladders are angled against another structure in a range of about 65° to about 85°, i.e., the base 34 of the rails 16 rest flat on a ground surface 36 while an upper section of the ladder abuts the structure the ladder is positioned to lean against. The lean angle cannot be too shallow (since the ladder may slide back) or too great (since the ladder may fall backwards) due to safety issues. The step adapter provides an acceptable safe support surface at preferred angles in a range of about 68° to about 78° as shown in FIGS. 9, 10 and 11 when the brace section is bent at an angle in a range of about 70° to 75° and most preferably at about 73°. As shown in FIG. 9, when the ladder is positioned at a 78° angle to the ground and the angle between the platform and brace sections is 73°, a 0° slope is present in the top surface of platform section 22. FIG. 10 shows that when the ladder is positioned at a 73° angle to the ground, a 73° angle between the platform and brace sections results in a 5° slope of the top surface of the platform element where the slope is downwards when moving from front (the brace section end) to back (the lock section end). In FIG. 11, it is shown that when the ladder is positioned at a 68° angle to the ground, a 73° angle between the platform and brace sections results in a 10° slope from front to back. Thus, the angle between the platform section 22 and brace section 24 is significant in controlling the level or slope of the support or step surface provided by platform section 22.

Figure 12:
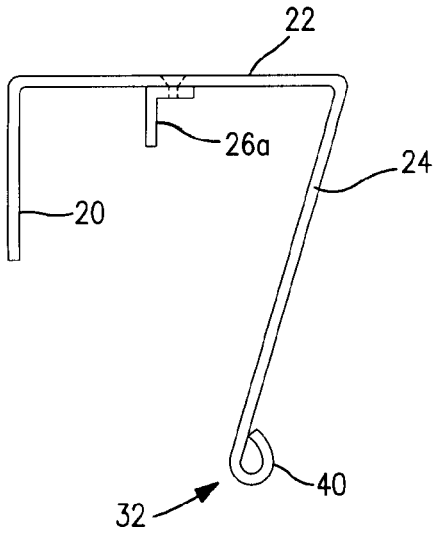
FIG. 12 is a side view of the step adapter of the first embodiment, where the opposite side view is a mirror image thereof, and where the bottom edge of the brace element is curled.
Figure 13:
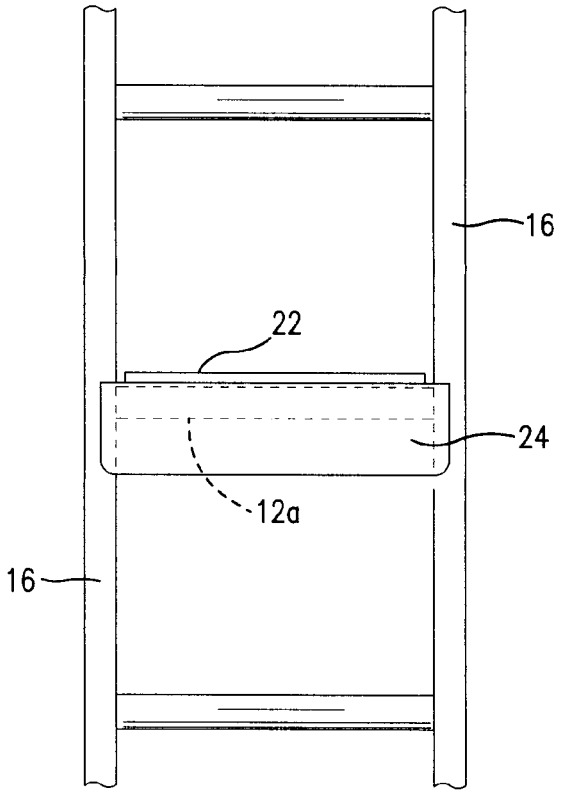
FIG. 13 is a front view of the step adapter of the first embodiment positioned on a rung ladder.

To prevent damage to rails 16 of a ladder (e.g., by gouging), the bottom edge 32 of the brace element can include one or more plastic bumpers 38 (as shown in FIG. 2) or be provided with a curled edge 40 (as shown in FIG. 12). The curled edge may curl inward or outward. The bumper(s) 38 can be one continuous strip across the bottom edge 32 or be two strips positioned on the bottom edge for alignment with the rails of a ladder. A preferred plastic is polyethylene or the like as shown to have enduring protective strength.

Examples of preferred dimensions of the elements or sections of the step adapter are described below. These dimensions are such as to allow the step adapter to be useful with various conventional commercially available rigid rung ladders. The lengths (i.e., front to back measurements as described above) are the inside measurements of the described element or section after the bends or angles along line A or line B are provided in the device.

The brace element or section has a width of about 17 inches (43.18 cm) to about 20 inches (50.8 cm) and a length of about 5 inches (12.7 cm) to about 7 inches (17.78 cm). A most preferred embodiment based on sizing the range of commercial rung ladders is a width of about 19 inches (48.26 cm) wide by 6 inches (15.24 cm) in length. The bottom free edge of the brace element can be curled outward or inward to prevent the edge from gouging, marking or otherwise damaging the rails of the ladder in use. The curl can be continuous across the bottom edge or non-continuous wherein the curl preferably extends at least about 3 inches (7.62 cm) inward from each side edge of the brace element, see for example FIG. 14 wherein the curl 40 extends inward as denoted by dashed line 40*a*. In providing for the curl in the sheet metal format, extensions of desired width and length are provided extending from the free end of the brace section and curled inward or outward as desired. Alternatively, one or more slip covers can be placed on the bottom edge at least at the point the brace will abut the rails so as to protect the rails. The slip covers are preferably made of a durable plastic, e.g., polyethylene, and have a width of about 3 inches (7.62 cm) to about 4 inches (10.6 cm) in width, or can be sized to extend substantially along or along the entire width of the bottom edge. Additionally, the brace element may include openings of a desired shape, preferably circular as shown at 31 in FIG. 14 (preferably of about ⅜ inch (9.525 mm) diameter) for receiving a clip attachment by which the step adapter could be carried and clipped to another structure for carrying or storage. Necessarily, such an opening could also be placed in another section of the step adapter (e.g., the platform section or lock section). However, since the brace section has the greater width, the opening(s) are preferably in the extended end(s) to allow for easier access to the openings in use and storage.

The platform element or section has a width of about 11 inches (27.94 cm) to about 13 inches (33.02 cm) in width and about 5 inches (12.7 cm) to about 7 inches (17.78 cm) in length. In a most preferred embodiment the platform element has a width of about 12½ inches (31.75 cm) by 5⅜ inches (13.6525 cm) in length.

The lock element or section has a width of about 11 inches (27.94 cm) to about 13 inches (33.02 cm) and a length of about 2 inches (5.08 cm) to about 4 inches (10.6 cm). In a most preferred embodiment, the lock element has a width of about 12½ inches (31.75 cm) and a length of about 3 inches (7.62 cm). As set forth above, the platform element and the lock element preferably are of the same width so as to provide the step adapter with clean lines with minimum corners or cuts. This contributes to allowing for simple fabrication of the step adapter and ease of use.

The safety element is positioned inward from line B on the underside of the platform element about 2 inches (5.08 cm) to about 4 inches (10.6 cm), most preferably about 2⅜ inches (6.0325 cm). The safety element includes a bar portion extending downward from the underside of the platform element. The distance between the lock element 20 when extended downward and the downward extending bar 26*a* of the safety element 26 is to be sufficient to position a ladder rung (whether round, semi-round or flat) therebetween. The bar portion is about 3 inches (7.62 cm) to about 6 inches (15.24 cm) in length and about ¾ inch (1.905 cm) to about 3 inches (7.62 cm) high. In the most preferred embodiment the bar portion is about 4 inches (10.6 cm) long and about 1¾ inches (4.445 cm) high. When the step adapter is a one piece injection molded structure, the safety element only requires the bar portion since, preferably, it is an integral part of the whole structure. When the step adapter is made from sheet metal, the safety element includes an extension or leg portion with the bar portion, preferably at a 90° angle to the bar portion. The leg portion will abut the underside of the platform and be fastened thereto by appropriate fastening means, such as rivets, screws, or the like. Preferably the fastening means are countersunk in the top surface of the platform so as to maintain an essentially uniform level in the top surface of the platform element since this is the surface a user will be stepping and standing on in use of the step adapter on a rung ladder. The leg portion will preferably have the same length as the bar portion, i.e., about 3 inches (7.62 cm) to about 6 inches (15.24 cm), and a width of about ¾ inch (1.905 cm) to about 1¼ inches (3.175 cm), with the preferred being about 4 inches (10.6 cm) to about 1 inch (2.54 cm).

Preferably two or three rivets are used to fasten the safety element to the platform element. Two rivets are adequate to provide sufficient fastening. In the absence of computer-controlled assembly or other assembly safeguard, three rivets can be used to prevent accidental mismounting, i.e., the bar portion of the safety element is to abut the rung of the ladder. This is achieved by having the two end rivets aligned with each other and the third rivet centered therebetween and out of alignment with the other two rivets. As an example of the spacing of the fastening elements, e.g., rivets, in a safety bar having dimensions of 1½ inches (3.81 cm) for the downward extending bar 26*a* and 4 inches (10.6 cm) in width, 3 inches (7.62 cm) preferably is between the two outermost rivets which should be evenly spaced from the ends. A third rivet, if desired, is then spaced between the two outermost rivets.

A further benefit in maintaining a level top surface to the platform element is the desirability of providing a non-skid surface to the top of the platform element. This can be provided by adhering to the surface an adhesive-backed non-skid material, e.g., rubber with grit provided thereon. Preferably, the non-skid material is permanently adhered to the top surface of the platform element. The non-skid material preferably has dimensions of about 4 inches (10.6 cm) in length by about 12⅜ inch (31.4325 cm) in width when used with the most preferred embodiment of the platform element of about 12½ inches (31.75 cm) in width and about 5⅜ inches (13.6525 cm) in length. The length and width of a non-skid surface can be adjusted as appropriate based on the size of the top surface of the platform element. Further, the non-skid material can be provided as a single strip or piece, or can be multiple small strips or pieces (of the same or different configuration) spaced over the width of the top surface of the platform section.

The choice of metal or injection molded plastic, thickness of metal or plastic, bend angles present are all selected for strength and stability, preferably so as to bear a weight of at least about 300 pounds (136.078 kg).

Figure 14:
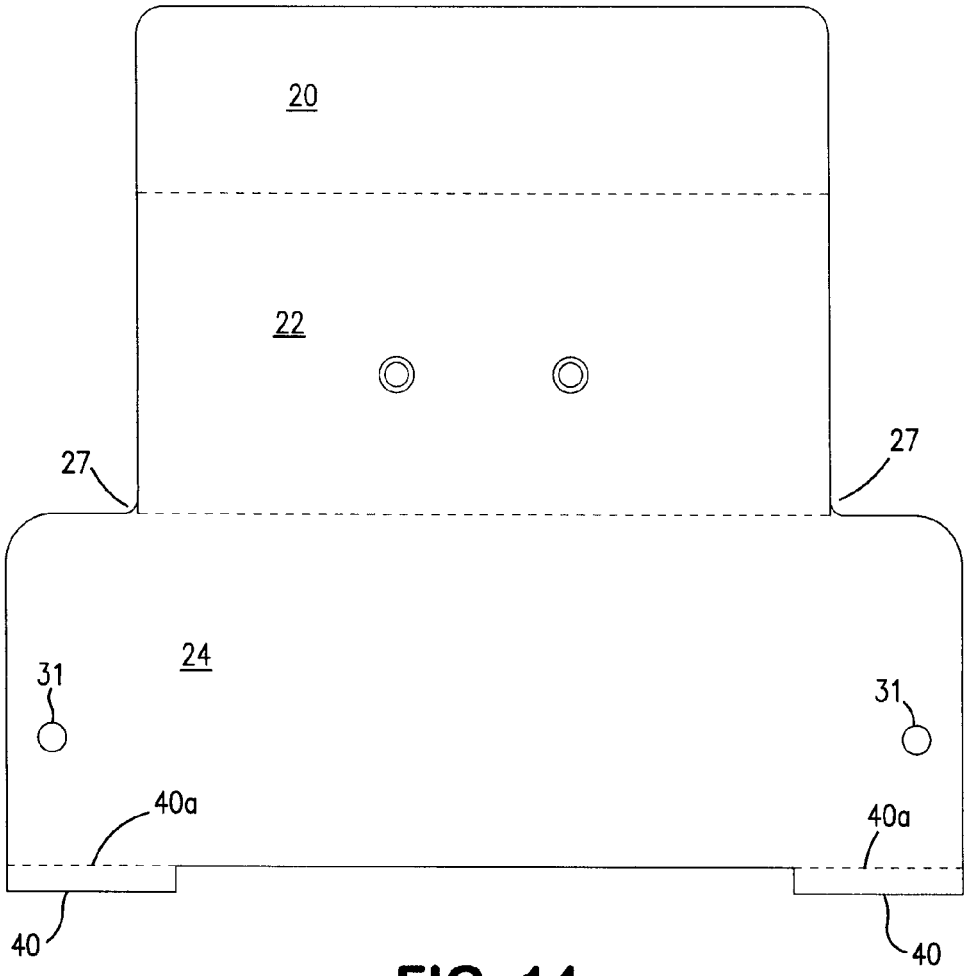
FIG. 14 is a top plan view of a sheet format similar to that shown in FIG. 7 and shows certain alternative features.

Tests were conducted on a step adapter as shown in FIG. 14 to show weight bearing capacity of the step adapter. The step adapter tested was made of sheet aluminum having a ⅛ inch (3.175 mm) thickness. Measurements taken at 200 pounds (lbs.), 300 lbs. and 400 lbs. (up to and including 432.6 lbs.) were identical throughout at a depression value of 10 mm for a first adapter tested and a value of 8.8 mm for a second adapter tested. The difference in values was attributed to the second step adapter being tested using more sensitive equipment. That the depression value did not rise with increasing weight in either case, indicates that 400 lbs. was tolerated with no physical change in weight bearing capacity. No permanent depression was found to be present in the step adapter.

To further show the significance of the structure of the step adapter, another step adapter structure was tested. This step adapter was as shown in FIG. 15 having a ⅛ inch (3.175 mm) thickness was identical to that tested and described above except that the brace section 24 had a rectangular cutout 42 with rounded corners 6 inches (15.24 cm) by 1¾ inch (4.445 cm) (such as could be used as a hand hold and/or to lessen the amount of aluminum used) and a cutout 44 in lock section 20 of 6½ inch (16.51 cm) by 2 inch (5.08 cm) to decrease the amount and weight of the aluminum used. A depression of 15 mm was shown at both of 200 lbs. and 300 lbs. This same step adapter structure with cutouts as in FIG. 15 but of a 1/10 inch (2.54 mm) thickness, was also tested. A 16 mm depression was observed at both 200 lbs. and 300 lbs. The test equipment used in the tests of the step adapters with two cutouts was the same as used for the first tests above on the step adapter with no cutouts.

A step adapter as shown in FIG. 15 except not containing cutout 42 (i.e., only containing cutout 44) was also tested as to weight bearing capacity at each of 200 lbs., 300 lbs., and 400 lbs. (up to and including 433.6 lbs.). The depression value of this step adapter was 8.8 mm. and did not rise throughout, even upon increasing the weight up to the tested amount of 433.6 lbs. The tests on this embodiment of the strip adapter were conducted using the same equipment used for the second tests described above on the step adapter with no cutouts. Accordingly, the results of tests on the step adapter embodiment with a single cutout in the lock section were equivalent to the results of the step adapter with no cutout, thereby indicating no physical change in weight bearing capacity even in the presence of cutout 44. These test results as compared to those of the step adapter containing both cutouts 42 and 44 indicate that cutout 42 in the brace section 24 is the feature causing a decrease in weight bearing capacity.

A second embodiment of the step adapter is shown in FIGS. 16-20. The second embodiment is similar to the first embodiment in that it contains a brace element 124, a platform element 122, and a lock element 120. However, the second embodiment of the step adapter does not include a safety element 26. Rather, in order to maintain the step adapter in place on a selected rung on a ladder, the second embodiment has a modified platform element in the nature of differently configured side edges 132 made up of edge sections 126, 127 and 128. Edge section 128 transitions to edge section 127 through an angle 130, which is preferably a rounded 90° angle. Edge section 127 then, at corner 131, transitions to edge section 126. Corner 131 is preferably a rounded 90° corner.

The step adapter of the second embodiment is bent along lines A and B in the same manner as the step adapter of the first embodiment. FIG. 16*a* shows the step adapter of the second embodiment bent along lines A and B at the preferred angle of 73° as between the brace element 124 and the platform element 122, and the preferred angle of 90° as between the platform element 122 and the lock element 120.

Figure 5:
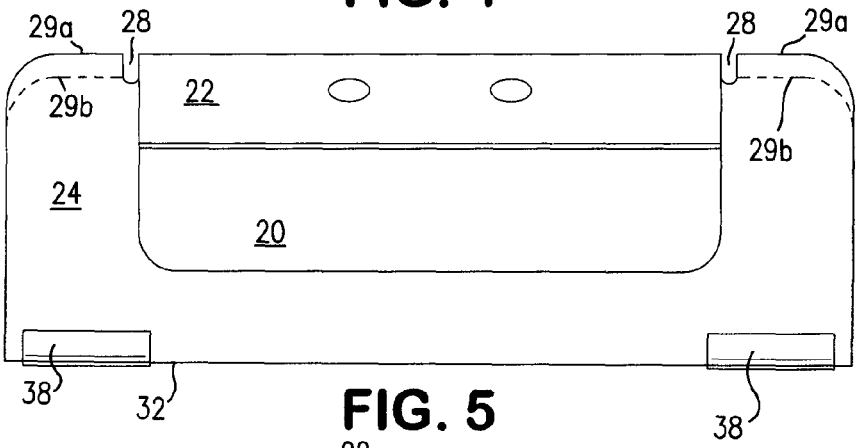
FIG. 5 is a rear plan view of the step adapter of the first embodiment.
Figure 6:
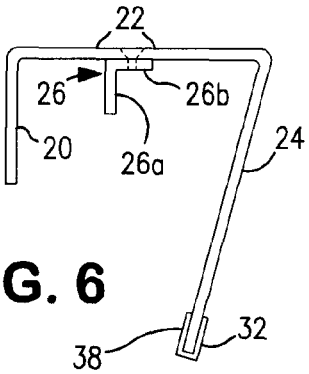
FIG. 6 is a first side view of the step adapter of the first embodiment where the opposite side view is a mirror image thereof.

When in place on a rung of a leaning ladder, edge section 128, which is the same width as lock section 120, extends through the rails of a ladder, and edge section 127 abuts the front of the rails of the ladder. With brace section 124 and edge section 127 abutting the rails of the ladder and lock section 120 around a rung between the rails, edge section 127 serves to keep the step adapter from moving forward through the rails thereby maintaining the step adapter in place on the ladder. The length of the edge section 126 is critical for blocking forward/inward motion of the step adapter when in place on a ladder. The length of edge section 126 is preferably about 2.6 inch (6.604 cm) to about 3 inches (7.62 cm), and most preferably about 2.875 inches (7.3025 cm). The total length of the edge section 132 is the same as in the platform element of the first embodiment, i.e., about 5 inches (12.7 cm) to about 7 inches (17.78 cm). The preferred total length of edge 132 is 5.625 inches (14.2875 cm) when edge section 126 is the preferred 2.875 inches (7.3025 cm). The length of edge section 128 is necessarily the difference between the total length of edge section 132 and the length of edge section 126. The width of edge section 127 preferably is the same as the plastic bumper 38 (when not continuous such as shown in FIG. 5) or curled edge 140. The most preferred width is about 3 inches (7.62 cm). The thickness of the format, whether metal or plastic, is the same for both the first and second embodiments. Further, the width of brace element 124, lock element 120 and platform section 122 is the same as in the first embodiment. The lock section preferably has a cutout 144 the same as cutout 44 in the first embodiment of the step adapter. The second embodiment of the step adapter can have additional features, such as openings 31, non-skid surface(s) on platform 122, curled edges 140, etc., in the same manner as described in relation to the first embodiment of the step adapter.

The advantages of the step adapters of the invention include the absence of moving parts, simplicity and low cost of manufacture, simplicity of use with no known way of misuse, and safety features. The step adapters can be sized to use with various commercially available rigid rung ladders. The width of the ladder from rail to rail is important since the width provided in the brace element must be sufficient to extend from rail to rail and abut the rails. The widths of the lock element and the platform element are selected so that they pass between the rails to engage and rest upon a selected rung of the ladder. The diameter or circumference of the rung is significant since size and spacing of the lock element and the safety element must be such so that the rung is engaged between the lock element and safety element so as to retain the rung therebetween when a step adapter is positioned for use on a rung ladder. Accordingly, ranges and preferred embodiments of sizes of the elements/sections of the step adapters are preferably selected to be useful with various commercially available rigid rung ladders or may be adjusted to be customized to a particular ladder structure.

Figure 21:
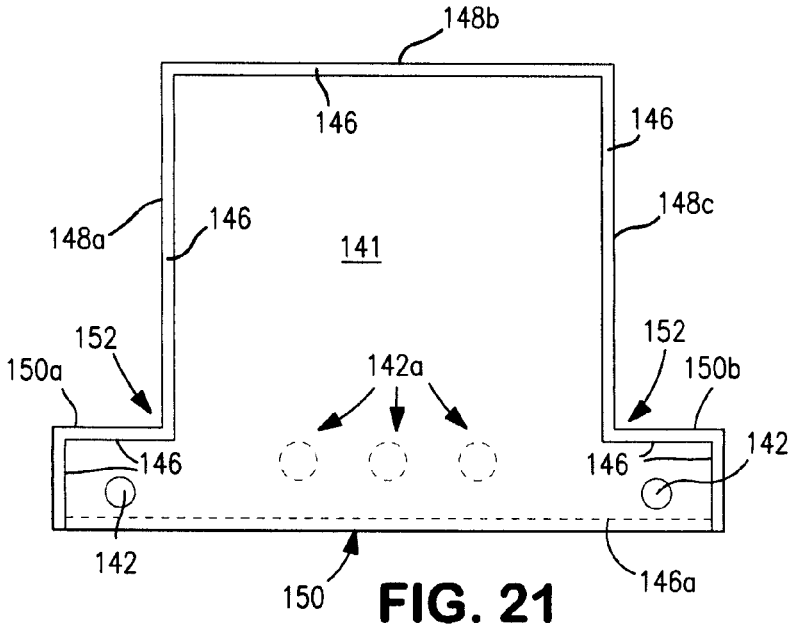
FIG. 21 is a top plan view of a service table or tray overlay which can be attached to either the first or the second embodiment of the step adapter.
Figure 22:
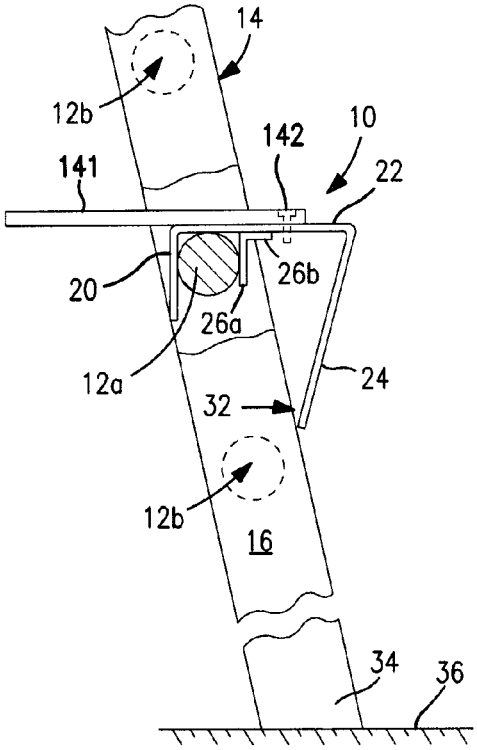
FIG. 22 is a side view of the service table or tray overlay of FIG. 21 attached to the top surface of the step adapter of the first embodiment when in place on a rung of a leaning rung ladder.
Figure 23:
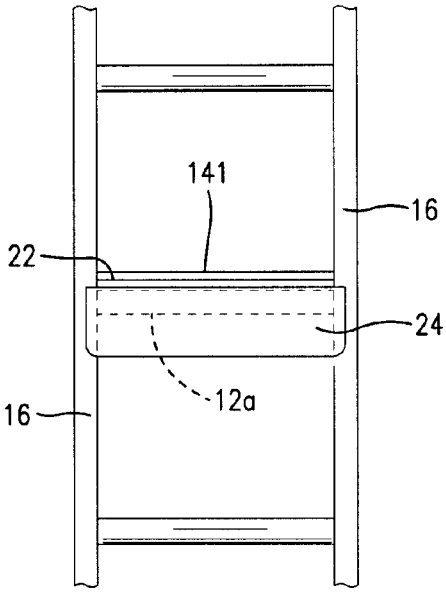
FIG. 23 is a front view of a step adapter with a service table or tray overlay thereon, where the step adapter is positioned on a rung ladder.

The step adapter in addition to being a support for a user of a rung ladder, may also serve as a support for a table or tray overlay to provide for a work area on which a user of a rung ladder can hold items, such as a paint can, tool(s), drink container, etc. The table or tray overlay is shown in FIGS. 21-23.

The overlay 141 is a one piece substrate which can be made of metal or plastic, and preferably is made of aluminum metal of a thickness which is preferably about 1/10 inch (2.54 mm) to about ⅛ inch (3.175 mm). The preferred thickness of a metal overlay is ⅛ inch (3.175 mm).

The overlay includes a first section bounded by sides 148*a*, 148*b*, and 148*c*. The width of this first section is preferably the same as the width of the platform element of the step adapter and is dimensioned to pass through the interior space between the rails of the ladder. The length is such that it may extend beyond the step adapter platform element as shown in FIG. 22. The overlay also includes a second section 150 having a width greater than the width of the first section and, preferably, the same as brace section 24 or 124. Transition angles 152 are present to provide a continuous structure between sides 148*a* and 148*c* and wing sides 150*a* and 150*b*, respectively, of the second section 150. At this point, wing sides 150*a* and 150*b* and sides 148*a* and 148*c* each abut the rails of the ladder when a step adapter containing an overlay thereon is seated upon a rung of a ladder. The overlay 141 preferably is attached by one or more suitable fastening elements, e.g., rivet(s), screw(s), bolt(s), or the like, through openings 142 and/or 142*a*. The table or tray overlay 141 will then be attached to the step adapter 10 as shown in FIGS. 22 and 23. Preferably, the openings are recessed so that when a fastening element is placed therein, the head will be countersunk to provide a uniform top surface to overlay 141.

Preferably, the overlay 141 has an upraised wall or curb 146 on one or more edges of the overlay. More preferably, curbs 146 are on all edges except the front edge of the second section 150. Curbs 146 and 146*a* can be present in a height of 0 to about ¼ inch (6.35 mm) or of a sufficient height generally to avoid items being positioned over an outer edge of the overlay and to avoid items falling off the overlay.

The top surface of the overlay may be provided with a non-skid surface, e.g., a grit material adhered to the top surface. Further, when the overlay is made of molded plastic, recessed areas may be formed therein to aid maintenance of items in place on the overlay, e.g., a circular recess of appropriate size to hold a drink container or paint container, a rectangular recess for holding one or more tools or the like, etc.

The various embodiments of the step adapter can also include at least one securing element to provide an added safeguard for maintaining the step adapter in place on a rung of a rung ladder during use. The securing element is structured to anchor the step adapter to at least one rail of the ladder on which the step adapter is positioned.

Figure 16:
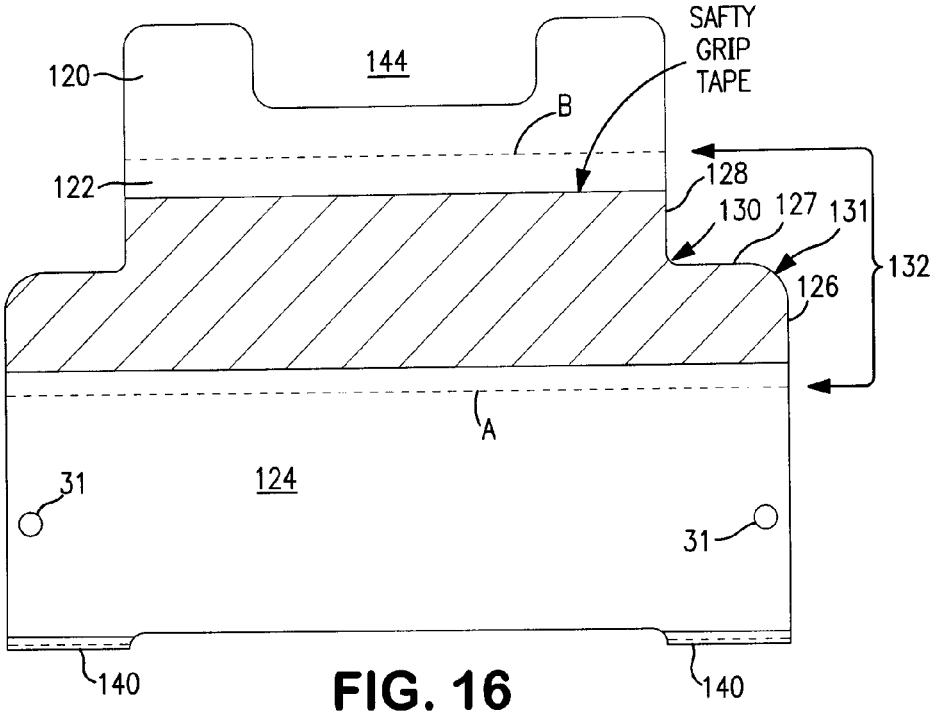
FIG. 16 is a top plan view of a sheet format which will form a step adapter of a second embodiment once the sections are angled appropriately.
Figure 16A:
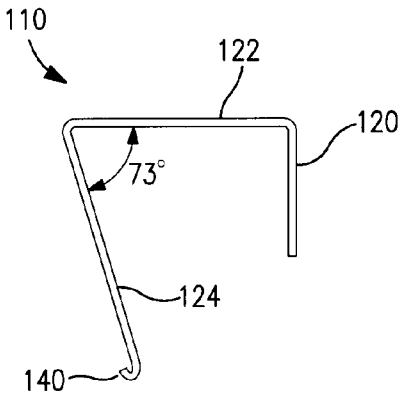
FIG. 16*a* is a side view of the sheet format of FIG. 16 angled to form the step adapter of the second embodiment wherein the opposite side view is a mirror image thereof.
Figure 17:
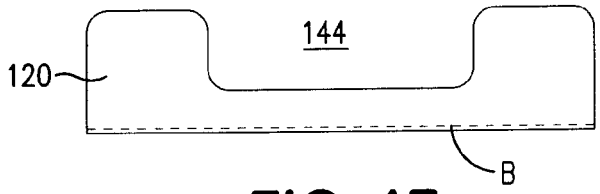
FIG. 17 is a plan view of the outside surface of the lock section of the step adapter of the second embodiment.
Figure 18:
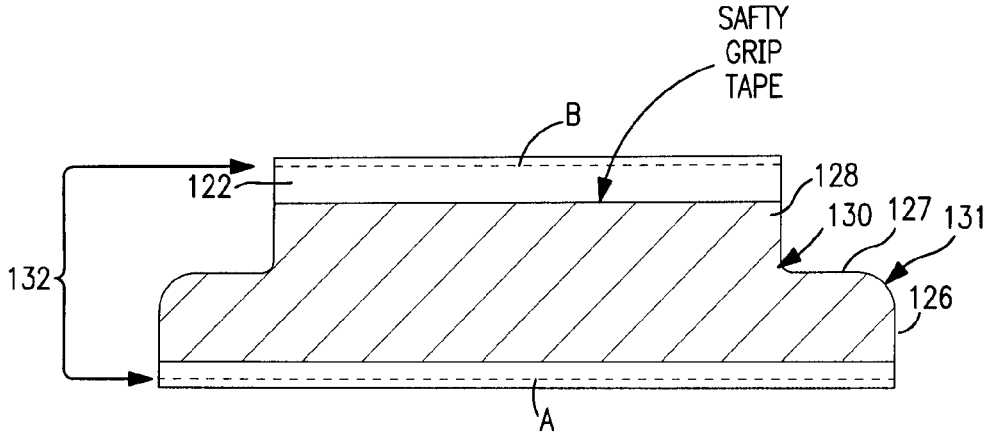
FIG. 18 is a plan view of the top surface of the platform section of the step adapter of the second embodiment.
Figure 19:
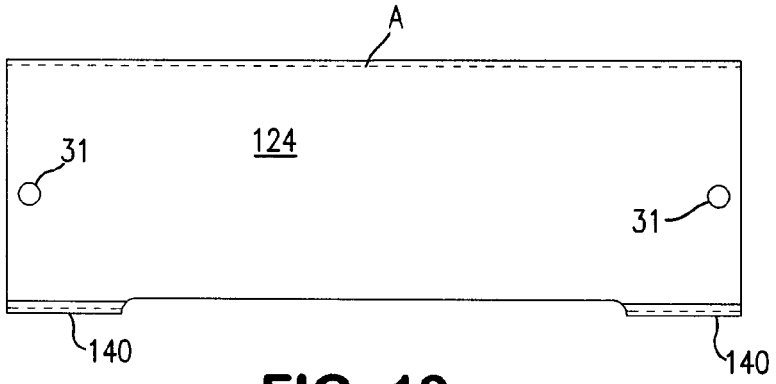
FIG. 19 is a plan view of the outside surface of the brace section of the step adapter of the second embodiment.
Figure 20:
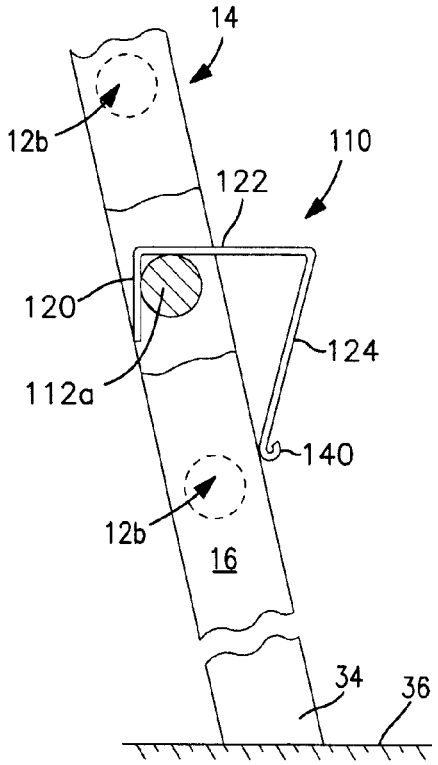
FIG. 20 is a side view of the step adapter of the second embodiment positioned in use on a rung of a leaning rigid rung ladder.
Figure 24:
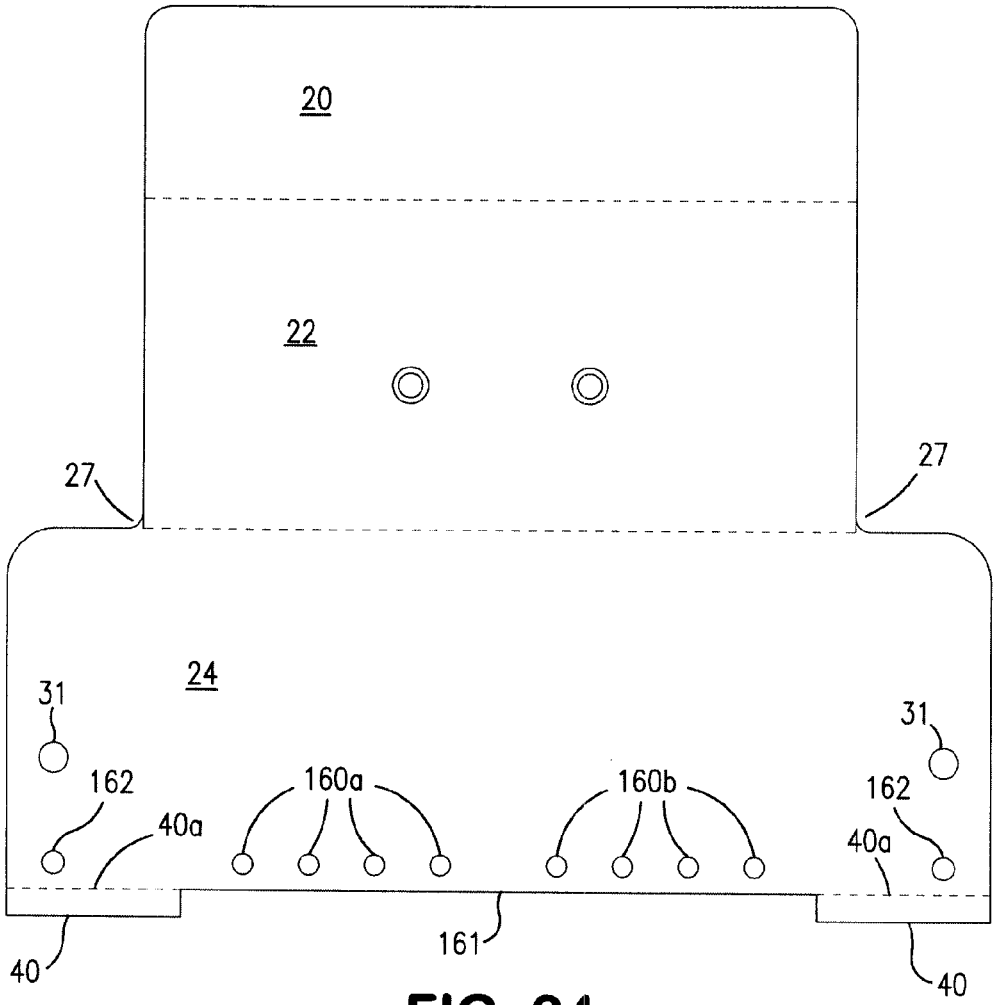
FIG. 24 is a top plan view of a sheet format similar to that shown in FIG. 14 but modified to be used with at least one securing element.
Figure 25:
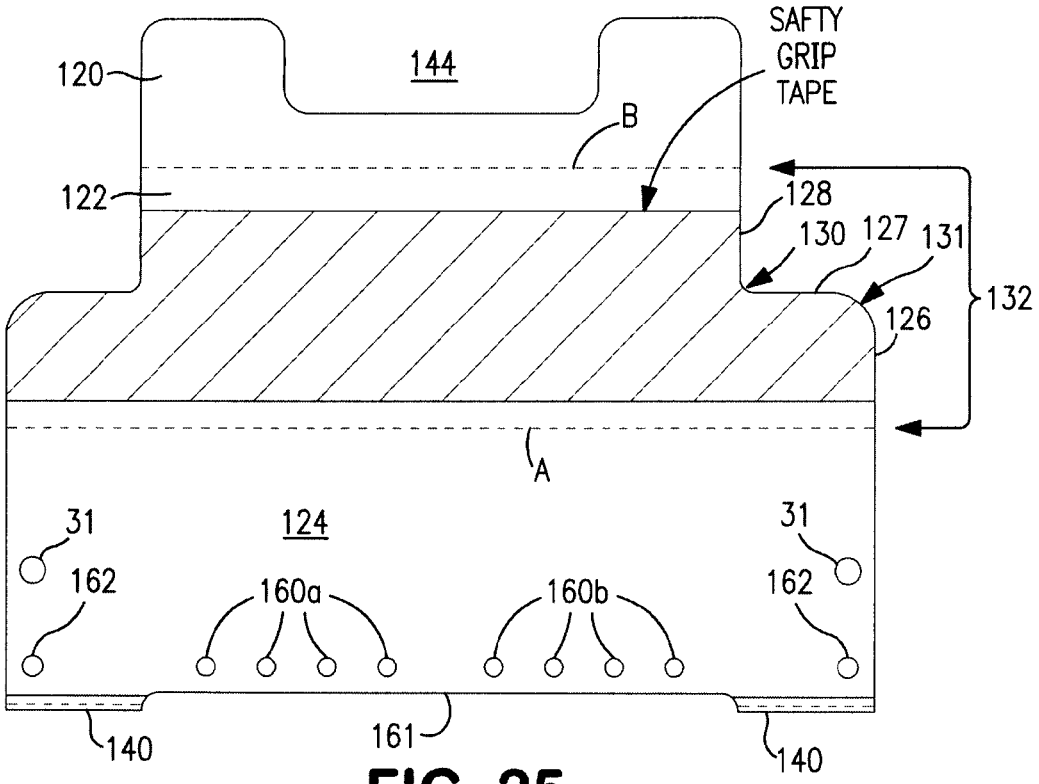
FIG. 25 is a top plan view of a sheet format similar to that shown in FIG. 16 but modified to be used with at least one securing element.

The step adapter of the embodiments, for example, shown in FIGS. 14 and 16, are modified as shown in FIGS. 24 and 25, respectively, to include spaced apart holes 160*a* and 160*b* positioned along or adjacent edge 161 of brace element 24, 124. The holes can be spaced apart according to different spacings. Each hole can selectively serve as an anchor point for one end of the securing element as further described below. Accordingly, the variation in spacing provides for alternate points for attachment by the securing element as further described below. As shown in FIGS. 24 and 25 the holes are present in two groups, i.e., one group including holes 160*a* and one group including holes 160*b*. A preferred arrangement, for example, has 13 inches (33.02 cm) present between curl portions 40, 140 where the first hole of a group is 1 inch (2.54 cm) over from the curl portion 40, 140 with 1 inch between each hole of a group and 1.5 inches (3.81 cm) between the two groups of holes 160*a* and 160*b*. The diameter of the holes is preferably ¼ inch (6.35 mm).

Figure 26:
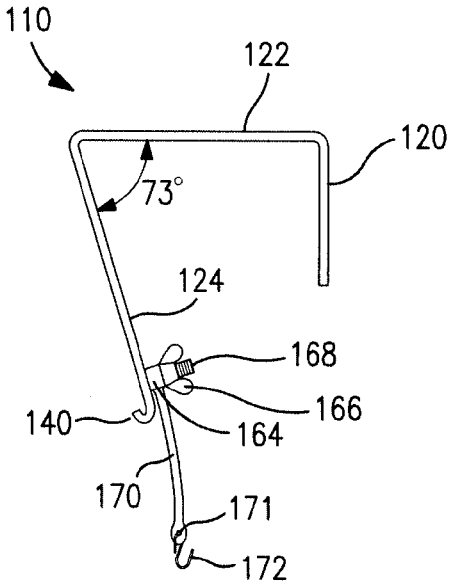
FIG. 26 is a side view of the sheet format of FIG. 25 angled to form a step adapter and including a securing element attached to the rear side of the brace element.
Figure 29:
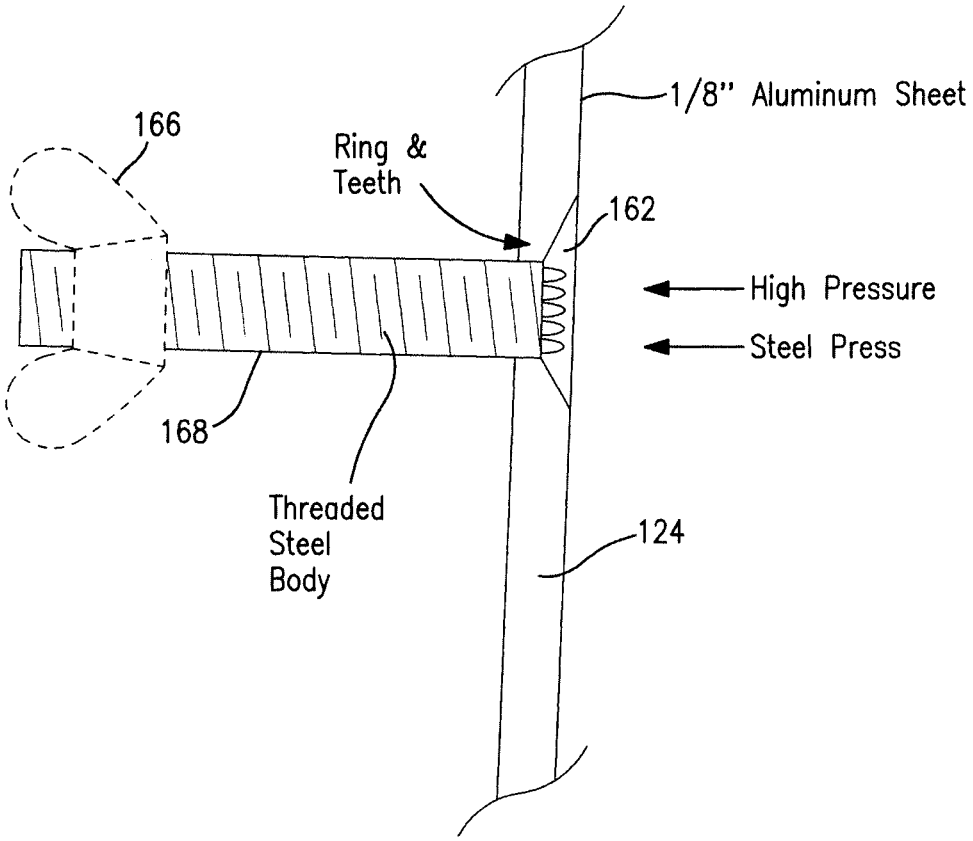
FIG. 29 shows an attachment member suitable for use with the securing element.

The securing element includes a first end 164, an elastic segment 170, and second end 171 having an attachment member, e.g., a hook element 172, attached thereto. The first end 164 is attached to brace element 24, 124 by a fastening member. An example of a fastening member suitable for use is shown in FIGS. 26 and 29. A head 162 of the fastening member is preferably flush with the outside face of brace element 24, 124. In the example shown in FIG. 29, the fastening member is a self-clinching stud which provides a strong permanent threaded fastener when used in a thin or soft material, such as aluminum sheeting used to make the step adapter. The head 162 of the stud is positioned in the sheet metal by a high pressure steel press. The steel ring and teeth of the head 162 of the self-clinching stud are forced into the ⅛ inch aluminum sheet. The threaded steel body 168 projects out the rear of the brace element 24, 124. The stud is positioned adjacent one or both ends of a side, e.g., ½ inch inward from the edge of the brace element. The head 162 is preferably flush with the outside surface of the brace plate. The threaded body is inserted into a hole present in a first end 164 of the securing element, which is retained on the threaded body 168 by a screw nut 166 or the like.

The elastic segment of the securing element may be between about 8 to about 15 inches (about 20.32 cm to about 38.1 cm) in length, preferably about 10 inches (about 25.4 cm) in length or more preferably, about 9 inches (about 22.86 cm). The second end 171 of the securing element has an attachment member, e.g., a hook 172, attached thereto, e.g., through a hole contained in the second end.

Figure 27A:
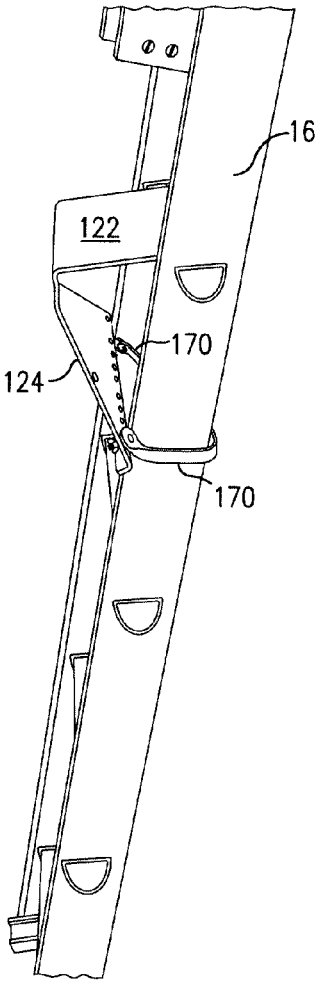
FIG. 27*a* shows a step adapter of FIG. 26 in place on a rung of a ladder including a securing element extending from one end of the step adapter around a rail of the ladder and attached to another portion of the step adapter.
Figure 27B:
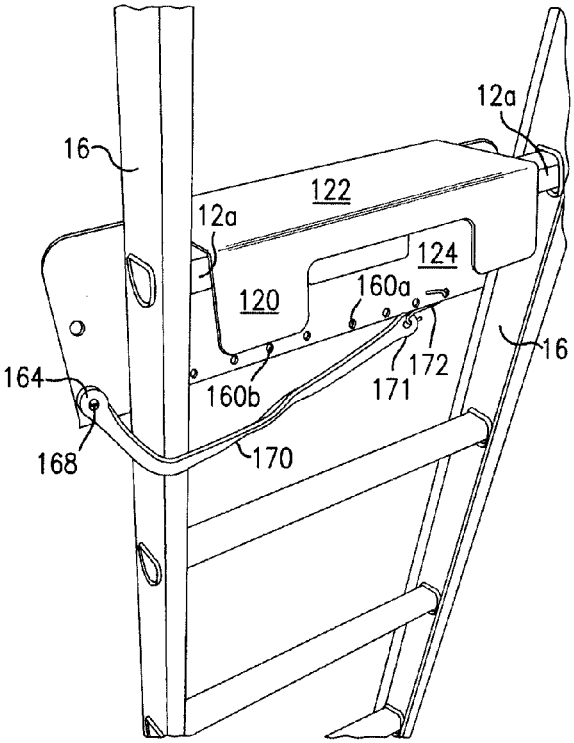
FIG. 27*b* shows the same embodiment of FIG. 27*a*, but from a rear perspective.
Figure 28A:
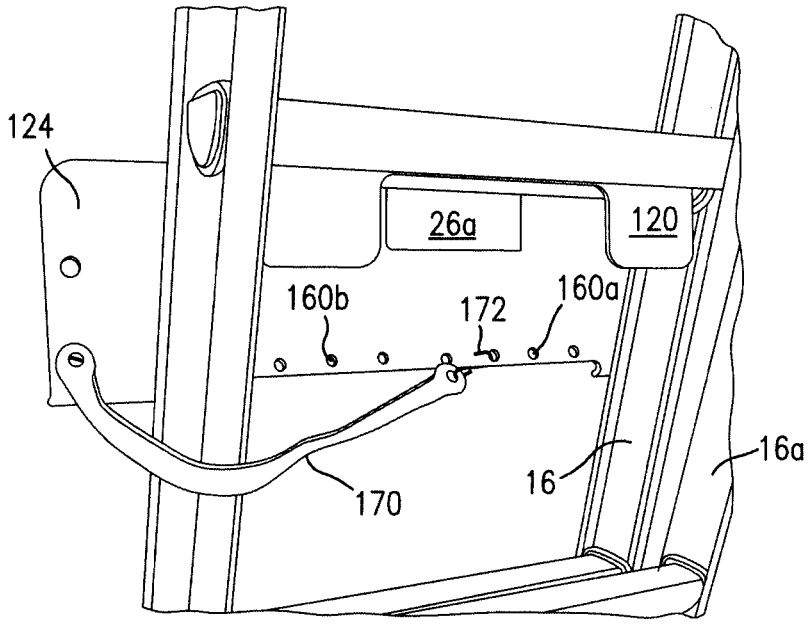
FIGS. 28*a* and 28*b* show a step adapter of FIG. 26 from different perspectives in place on a rung of a ladder when the ladder is not in a fully extended position and two rails or legs of the ladder coincide, and the securing element extends around both rails of the ladder.
Figure 28B:
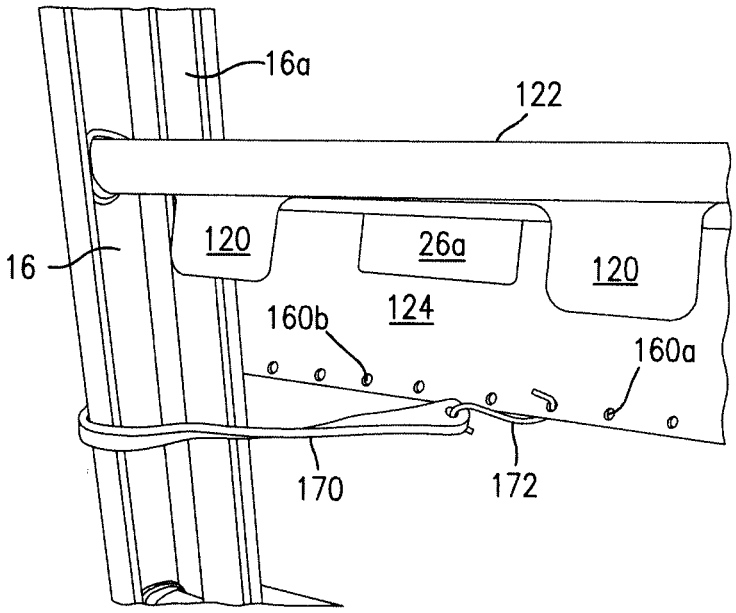

In use, once the step adapter is placed on a desired rung of a ladder, the securing element is extended around a rail 16 of the ladder and the hook engaged in one of the holes 160*a* or 160*b*. The hole chosen is selected based on the length of the elastic segment 170 and the achievement of tautness such that the securing element acts as an additional safety feature to hold or anchor the step adapter in place on a rung. The securing element can extend around a single rail 16 of the ladder as shown in FIGS. 27*a* and 27*b*, or extended around two rails 16 and 16*a* as shown in FIGS. 28*a* and 28*b* if the ladder is not fully extended. This will also be a factor in achieving a desired tautness of the elastic segment 170 and, thus, hole in which the hook is situated.

A securing element can be positioned at each end of the step adapter so that a securing element can be moved from one side or the other to insure good access for properly positioning the securing element. Alternatively, a securing element can be positioned at each end.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

We claim:

1. A step adapter for a rung ladder comprising (a) a brace element, (b) a platform element, (c) a lock element, (d) a safety element, and (e) a securing element;

wherein (a), (b) and (c) are of one piece;

wherein said brace element has a first width having two side edges, a terminal end configured, in at least a portion thereof, as a curl with a convex surface facing outward and away from said step adapter, a plurality of spaced apart holes, and opposite said terminal end is a transition area where said brace element transitions at an angle to the platform element so that said brace element extends at a downward angle from said platform element;

wherein said platform element has a second width which is less than said first width, and opposite the transition area between the brace element and the platform element is a second transition area between said platform element and said lock element where said lock element transitions at an angle from said platform element to extend at a downward angle from said platform element;

wherein said safety element includes at least a bar portion extending from an underside surface of said platform element in a spaced position from said lock element; and wherein said securing element comprises a first attachment member, an elastic segment, and a second attachment member; where said first attachment member is connected to a first end of the elastic segment and the second attachment member is connected to a second end of said elastic segment; and said first attachment member and said second attachment member are attached or attachable to said step adapter.

2. The step adapter of claim 1 wherein said first attachment member and/or said second attachment member is adapted to engage one of said plurality of spaced apart holes.

3. The step adapter of claim 2 wherein at least one of said first attachment member or said second attachment member is a hook element.

4. The step adapter of claim 1 wherein (a), (b) and (c) are composed of one piece of sheet metal.

5. The step adapter of claim 1 wherein (a), (b) and (c) are a one piece injection molded plastic structure.

6. The step adapter of claim 1 wherein said safety element is an angled element fastened to an underside of said platform element.

7. The step adapter of claim 1 wherein said angle between said platform element and said lock element is greater than the angle between said platform element and said brace element.

8. The step adapter of claim 1 wherein said lock element and said bar portion extend downward at a common angle from the platform element.

9. A step adapter for a rung ladder comprising (a) a brace element, (b) a platform element, (c) a lock element, (d) a safety element, and (e) a securing element;

wherein (a), (b) and (c) are of one piece;

wherein (b), (c) and (d) are of a width and structure to pass between two rails of a rung ladder and over a rung supported by said rails;

wherein said brace element has a width sufficient to extend across and abut an exposed outer surface of said two rails, wherein said brace has a terminal end which is configured as a curl with a convex surface facing outward and away from said step adapter, and wherein said brace element includes a plurality of spaced apart holes;

wherein said lock element and said safety element are constructed and arranged to in combination partially surround the rung and in conjunction with said brace element secures said step adapter to a rung ladder;

wherein said platform element has a length which extends outward of said rails when said step adapter is secured to a rung ladder so that said platform element provides a step structure; and wherein said securing element comprises a first attachment member, an elastic segment, and a second attachment member; where said first attachment member is connected to a first end of the elastic segment and the second attachment member is connected to a second end of said elastic segment; and said first attachment member and said second attachment member are attached or attachable to said step adapter.

10. The step adapter of claim 9 wherein said first attachment member and/or said second attachment member is adapted to engage one of said plurality of spaced apart holes.

11. The step adapter of claim 10 wherein at least one of said first attachment member or said second attachment member is a hook element.

12. The step adapter of claim 9 wherein (a), (b) and (c) are composed of one piece of sheet metal.

13. The step adapter of claim 9 wherein (a), (b) and (c) are a one piece injection molded plastic structure.

14. The step adapter of claim 9 wherein said safety element is an angled element fastened to an underside of said platform element.

15. A step adapter for a rung ladder comprising (a) a brace element, (b) a platform element, (c) a lock element, and (d) a securing element;

wherein (a), (b) and (c) are of one piece;

wherein said brace element has a first width, two side edges, a terminal end configured, in at least a portion thereof, as a curl with a convex surface facing outward and away from the step adapter, a plurality of spaced apart holes, and opposite said terminal end is a first transition area where said brace element transitions at an angle to the platform element so that said brace element extends at a downward angle from said platform element;

wherein said platform element has a second width and a third width, wherein the second width is the same as the first width and the third width is less than said first width, wherein said platform element has continuous side edges including therein an angle at a point where the second width transitions to said third width, and wherein opposite the first transition area between the brace element and the platform element is a second transition area between said platform element and said lock element where said lock element transitions at an angle from said platform element to extend at a downward angle from said platform element; and wherein said securing element comprises a first attachment member, an elastic segment, and a second attachment member; where said first attachment member is connected to a first end of the elastic segment and the second attachment member is connected to a second end of the elastic segment; and said first attachment member and said second attachment member are attached or attachable to said step adapter.

16. The step adapter of claim 15 wherein said first attachment member and/or said second attachment member is adapted to engage one of said plurality of spaced apart holes.

17. The step adapter of claim 16 wherein at least one of said first attachment member or said second attachment member is a hook element.

18. The step adapter of claim 15 wherein (a), (b) and (c) are composed of one piece of sheet metal.

19. The step adapter of claim 15 wherein (a), (b) and (c) are a one piece injection molded plastic structure.

20. The step adapter of claim 15 wherein said angle between said platform element and said lock element is greater than the angle between said platform element and said brace element.

* * * * *